US006467525B2

(12) United States Patent
Herreid et al.

(10) Patent No.: US 6,467,525 B2
(45) Date of Patent: Oct. 22, 2002

(54) GELATIN COATED SAND CORE AND METHOD OF MAKING SAME

(75) Inventors: Richard M. Herreid; Brian J. Srsen, both of Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 09/911,271

(22) Filed: Jul. 23, 2001

(65) Prior Publication Data

US 2002/0026994 A1 Mar. 7, 2002

Related U.S. Application Data

(60) Provisional application No. 60/220,304, filed on Jul. 24, 2000.

(51) Int. Cl.[7] ..... B22C 9/12; B22C 1/16

(52) U.S. Cl. ..... 164/12; 164/522; 164/525; 106/38.4

(58) Field of Search ..... 164/12, 15, 520, 164/522, 525, 528, 349; 106/38.4

(56) References Cited

U.S. PATENT DOCUMENTS 5,582,231 A * 12/1996 Siak et al. ..... 164/525
6,016,862 A * 1/2000 Herreid ..... 164/525

* cited by examiner

*Primary Examiner*—M. Alexandra Elve
*Assistant Examiner*—Kevin P. Kerns
(74) *Attorney, Agent, or Firm*—IPLM Group, P.A.

(57) ABSTRACT

In a method of making a molded article for use in a casting process, sand particles are mixed with protein and water to effect a coating of protein on the sand particles. Then, the protein coated sand particles are dried and blown into a pattern mold to form a molded article without active cooling of the coated sand particles. Steam is then passed through the molded article to hydrate and melt the protein, thereby forming bonds between contiguous sand particles. Finally, hot, dry air is passed through the molded article to harden the protein bonds between the contiguous sand particles. This forms a protein coated sand core for use in casting molten metals.

20 Claims, 3 Drawing Sheets

GELATIN COATED SAND CORE AND METHOD OF MAKING SAME

This application claims the benefit of U.S. Provisional Application No. 60/220,304, filed Jul. 24, 2000.

BACKGROUND OF THE INVENTION

1. Field of the Invention

The present invention relates to a sand core and a method of making a sand core.

2. Description of the Prior Art

Molds for casting molten metals comprise several mold members working together to define the internal and external shape of the casting. Such mold members include core members for forming and shaping the interior cavities of the casting. The core members are typically made by mixing sand with a binder, introducing the binder-sand mix into a mold containing a pattern for shaping the sand-binder mix to the desired shape for making the metal casting, and curing/hardening the binder in the pattern mold to harden the binder and to fix the shape of the mold-forming material.

Gelatin has been used as a binder for the sand. Gelatin is desirable because it is water soluble, environmentally benign, and less costly than synthetic resins used in many sand-binder systems. In addition, less heat is required to break the bonds of the gelatin's protein structure to thermally degrade the binder than is required for the synthetic resin binders. As a result, in the case of mold members which are cores, the gelatin binders break down readily from the heat of the molten metal, and thereby permit ready removal of the core sand from the casting with a minimum of additional processing such as shaking or hammering. Moreover, because the gelatin is water soluble, any sand that is not removed from the casting mechanically can be readily washed therefrom with water. Solubility of gelatin also permits ready washing of the binder from the sand for recycling and reuse of the sand to make other mold members and thereby eliminate the cost of using new sand for each mold.

Gelatin is a protein material obtained by the partial hydrolysis of collagen, the chief protein component of skin, bone, hides and white connective tissue of animals and is essentially a heterogeneous mixture of polypeptides comprising amino acids including primarily glycine, proline, hydroxyproline, alanine, and glutamic acid. Gelatin is sold commercially as a by-product of the meat producing industry. "Dry" commercial gelatin actually has about 9% to about 12% by weight water entrained therein, and is an essentially tasteless, odorless, brittle solid having a specific gravity between about 1.3 and 1.4. Gelatins have a wide range of molecular weights varying from about 15,000 to above 250,000, but can be separated one from another by suitable fractionation techniques known to those skilled in the art. Gelatins are classified by categories known as "Bloom" ratings or numbers. The Bloom rating or number is determined by the Bloom test which is a system for rating the strength of gels formed from different gelatins. Gelatins having high Bloom ratings/numbers comprise primarily polypeptides with higher average molecular weights than gelatins having lower Bloom ratings/numbers. The Bloom rating/number is determined by evaluating the strength of a gel formed from the gelatin. Typically, the viscosity of the gelatin is measured at the same time as the Bloom rating/number by using the same gelatin sample as is used for the Bloom test. The viscosity of the gelatin is generally correlated to the Bloom rating/number. In other words, as the Bloom rating/number increase so does the viscosity.

U.S. Pat. No. 5,320,157 to Siak et al. teaches an improved gelatin binder for sand core members wherein a ferric compound is incorporated into the binder. The ferric compound enhances the thermal breakdown of the binder during the casting process thereby simplifying removal of the spent sand from the cast article. A typical method for forming a core mold is disclosed.

U.S. Pat. No. 5,582,231 to Siak et al. requires chilling the gelatin coated sand with or without rehydration to ambient temperatures or below before blowing the gelatin coated sand into the mold. This chilling step is performed so that the gelatin coating will gel when it is hydrated and the sand will be less sticky. The chilling step can require expensive cooling systems in metal foundries where the environment is typically warm due to the presence of molten metals. When the hydrated, coated sand temperature is above ambient temperatures, the gelatin gel coating melts and the sand is sticky, which hinders the flow of the sand. However, even if the hydrated, coated sand is chilled, it still does not flow as well as dry sand or even sand coated with phenolic urethane (cold box) resin.

In another patent to Siak et al., U.S. Pat. No. 5,749,409, a method for providing a topcoat of refracting particles to a foundry core formed from gelatin coated sand is disclosed. An organic waterproof layer is applied to the surface of the core and the refractory particles are then applied as an aqueous suspension. The waterproof layer protects the core from deterioration resulting from water in the aqueous suspension. The core is formed according to the description in U.S. Pat. No. 5,320,157.

U.S. Pat. No. 2,145,317 to Salzberg teaches the use of a mixture of a soluble proteinaceous material such as gelatin and a crystallizable carbohydrate as a binding material for making baked foundry cores. The method of forming core molds is discussed in general terms.

A method for removal of a sand core from a molded product with water is taught in U.S. Pat. No. 5,262,100 to Moore et al. This patent discloses binder materials including carbohydrates and proteins such as gelatin. A general process for forming a core mold is described.

U.S. Pat. No. 5,580,400 to Anderson et al. discloses packaging materials formed from fiber reinforced aggregates held together by organic binders including gelatin. Various methods of forming molded articles are disclosed.

SUMMARY OF THE INVENTION

In a preferred embodiment method of making a molded article for use in a casting process, sand particles are mixed with protein and water to effect a coating of protein on the sand particles. The protein coated sand particles are then dried and blown into a mold without active cooling. Steam is then passed through the protein coated sand particles to hydrate and melt the protein, thereby forming bonds between contiguous sand particles to form a molded article. Hot, dry air is then passed through the molded article to harden the protein bonds between contiguous sand particles.

In a preferred embodiment method of making a sand core, sand particles are mixed with gelatin and water while supplying heat, wherein the heat melts the gelatin to effect a coating of gelatin on the sand particles and dries the gelatin coated sand particles. The dry, gelatin coated sand particles are blown into a mold without active cooling, and then steam is passed through the gelatin coated sand particles to hydrate and melt the gelatin, thereby forming bonds between contiguous sand particles to form a molded article. Hot, dry air is then passed through the molded article to harden the gelatin bonds between contiguous sand particles.

In another preferred embodiment method of making a sand core, sand particles are mixed with gelatin and water to create a mixture. Heat is supplied to the mixture to effect a coating of gelatin on the sand particles and to dry the water thereby drying the mixture. The dried mixture is then ground thereby making the mixture free flowing, and the dry, gelatin coated sand particles are blown into a mold. Steam is passed through the gelatin coated sand particles to hydrate and melt the gelatin, thereby forming bonds between contiguous sand particles to form a molded article. Hot, dry air is passed through the molded article to harden the gelatin bonds between contiguous sand particles.

In another preferred embodiment method of making a sand core, sand particles are heated to above 40° C. and then mixed with gelatin and water, wherein the heated sand particles melt the gelatin thereby coating the sand particles with gelatin. The gelatin coated sand particles are then dried and blown into a mold. Steam is passed through the gelatin coated sand particles to hydrate and melt the gelatin, thereby forming bonds between contiguous sand particles to form a molded article. Hot, dry air is passed through the molded article to harden the gelatin bonds between contiguous sand particles.

In another preferred embodiment method of making a sand core, sand particles are mixed with protein and water to effect a coating of protein on the sand particles. The protein coated sand particles are then dried and blown into a mold. The protein coating the sand particles is then rehydrated within the mold thereby forming bonds between contiguous sand particles to form a molded article. Hot, dry air is then passed through the molded article to harden the protein bonds between contiguous sand particles.

DETAILED DESCRIPTION OF THE PREFERRED EMBODIMENT

Figure 1:
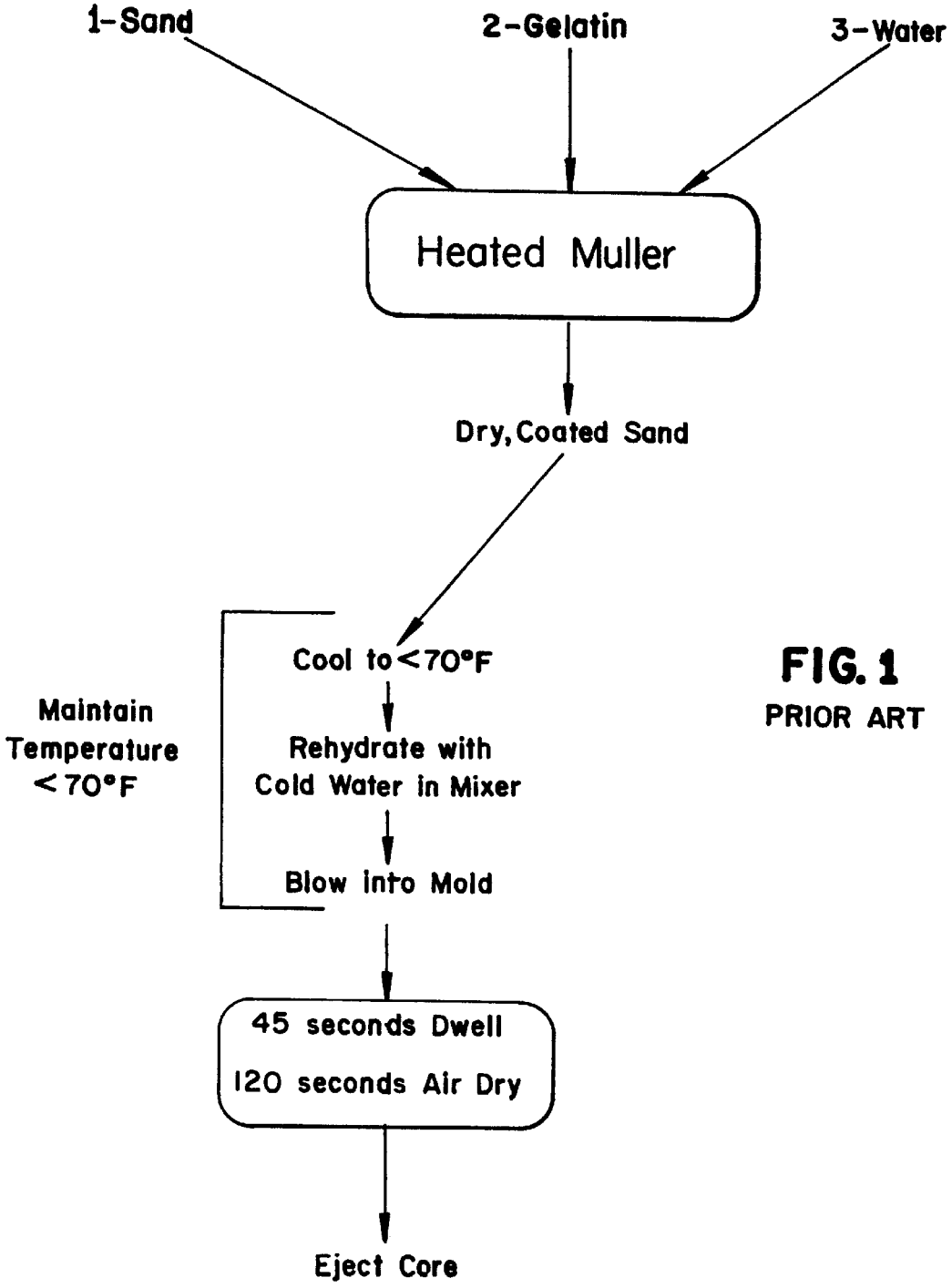
FIG. 1 PRIOR ART
FIG. 1 shows a prior art process for making a sand core.

FIG. 1 shows a prior art process for making a sand core. Prior art generally teaches coating sand particles with an aqueous solution of gelatin at about 80 to 100° C., cooling the coated particles to about ambient temperature (e.g. 21±2° C.) to promote gelling of the gelatin prior to core blowing, and then conditioning the gel coated sand to provide a water content in the coating of 70 wt % to 85 wt %. In this process, cooling the sand prior to blowing the sand into the core box is important because if the sand is warm, the gelatin will become sticky and the sand will not flow easily into the core box. The coated, conditioned sand is blown into a pattern mold which is at or is heated to 80° C. to 120° C. to promote melting of the gelatin gel and formation of gelatin bonds between sand particles. The gelatin is hardened by passing hot dry air through the porous molded core to reduce the water content to less than 15 wt %. Control of temperature during the blowing step appears to be critical to prevent premature drying of the gelatin. Premature drying can cause the coated sand to become "sticky" and clog the equipment.

Figure 2:
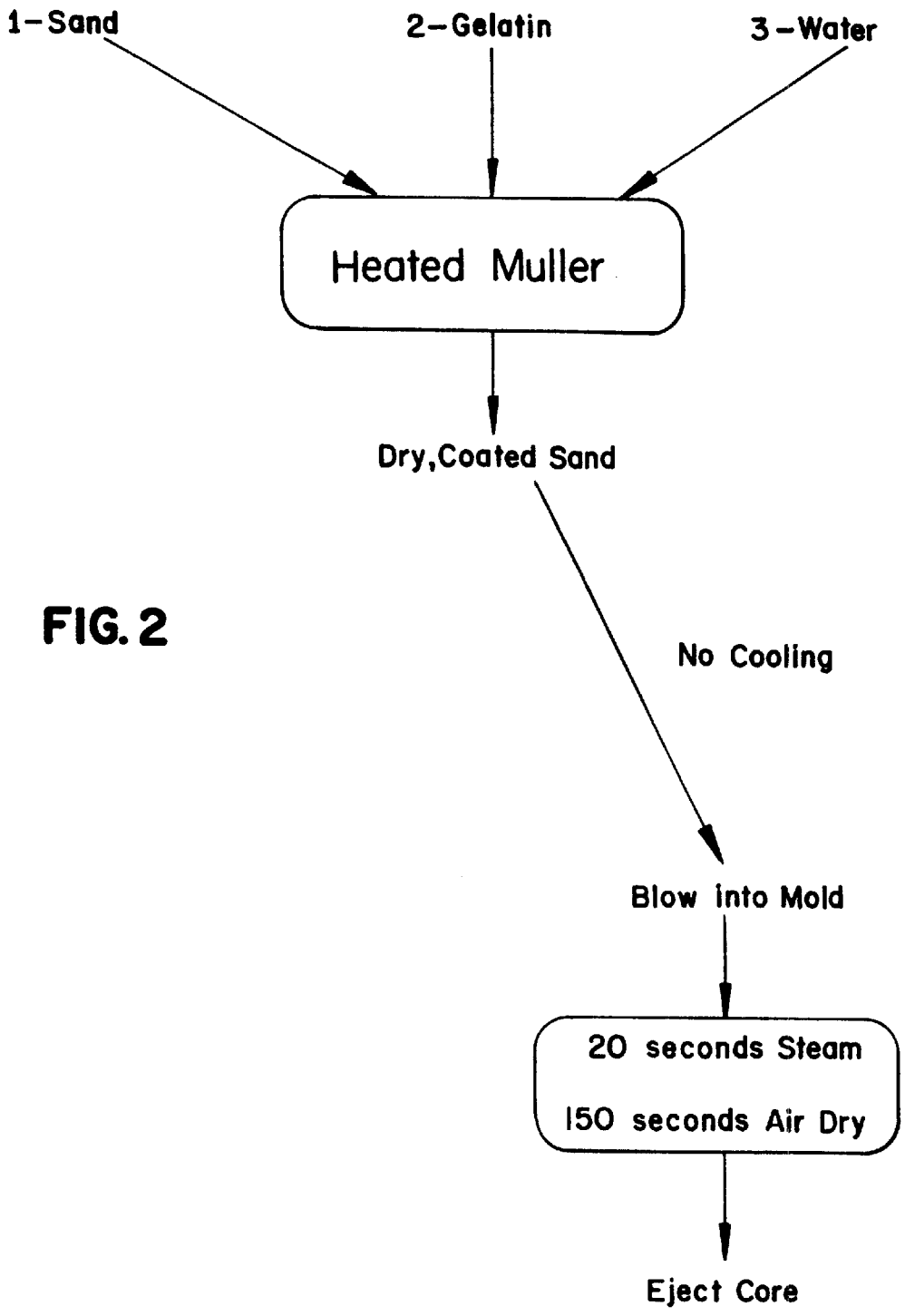
FIG. 2 shows the process of the present invention for making sand core.

FIG. 2 shows the preferred embodiment method of making a molded article for use in a casting process. Generally, the present invention is a process of using dry, gelatin coated sand particles that are blown into a core box, hydrating and melting the gelatin with steam through the core box, and then drying the gelatin with a dry air purge to harden the gelatin between contiguous sand particles. A preferred embodiment of the present invention utilizes a gelatin of the type disclosed in U.S. Pat. No. 5,582,231 to Siak et al., which is incorporated by reference herein. It is also understood that other gelatin or protein binders known in the art may be used in this process. However, the present invention does not require active cooling of the coated sand, and the coated sand possesses excellent flow characteristics similar to dry sand. The flow properties of gelatin coated sand are important in the correct functioning of the sand in automatic core machines used in commercial foundries. The sand must readily flow from hoppers above the core machine into the sand magazine in preparation for blowing a core. Then the sand must also flow uniformly into the core box during the blowing of the core using high pressure air.

In the preferred embodiment, first sand particles, water, and gelatin are mixed in a muller with a heat source until the sand particles are coated with gelatin and then the gelatin is dried. The gelatin is used at about 0.5 to 2.0% of the sand weight. The gelatin to water ratio should be sufficient so that when heated above the gelatin melting point, which is approximately 40° C., a gelatin solution is formed with low enough viscosity that it will flow around the sand particles to coat them. The gelatin to water ratio should be about 1:1 to 1:5, with the optimum gelatin to water ratio being 1:2 to 1:3. Excess water at this point just requires more energy to remove it during the drying process. The water can be dried from the gelatin coated sand while mixing by supplying excess heat to the mixture beyond what is required to melt the gelatin. In practice this means using temperatures of approximately 60 to 120° C., the optimum temperature of the mixture being approximately 80 to 90° C. The heat source may either be a heated muller or sand that is heated prior to mixing it with water and gelatin in the muller. Although the present invention utilizes a muller, it is recognized that any type of mixer that will uniformly mix the gelatin, sand, and water in a reasonable amount of time may be used. Using heat during the mixing step melts the gelatin to coat the sand particles, and the excess heat dries the moisture from the gelatin coated sand particles. The gelatin should be dried so that the gelatin contains less than 15% moisture by gelatin weight. Drying the mixture in the mixer is convenient because the mixer can break up the coated sand into a free flowing material that is easy to transfer and blow into molds. The dry, gelatin coated sand particles are approximately 65 to 95° C. when removed from the muller. However, the gelatin coated sand particles could be removed from the mixer before the gelatin is dried and either air-dried or dried in an oven at the above temperatures. Then the dry, coated sand would likely need to be ground to make it free flowing for blowing into the mold. Again, the gelatin should be dried so that it contains less than 15% moisture by gelatin weight.

After the sand is coated in a heated muller and the gelatin is dried, no active cooling of the coated sand particles is required prior to blowing the coated sand particles into the mold as required in the prior art. Depending on the size of the system, some cooling of the coated sand particles may occur during the transfer of the coated sand from the muller to the mold, but active cooling of the coated sand particles is not a required step in this process. The present invention eliminates the active cooling and conditioning steps prior to molding by blowing the dry, coated sand particles recovered from the coating step directly into a pattern mold. The temperature at which the coated sand particles are blown into the mold does not matter as long as the temperature is below the boiling point of water. The dry, free flowing coated sand particles do not clump together or stick to the sides of the pattern mold when being blown into the pattern mold, and this helps create a uniform mold because gaps in the sand particles are not formed in the pattern mold.

In the preferred embodiment using a "dog bone" test core mold having a standard shape with a center cross section area of one square inch, approximately 100 grams of dry, coated silica sand particles are blown into the mold at a preferred temperature range of 21 to 66° C. The "dog bone" test core mold used in the present invention has the dimensions shown and described under Procedure AFS 3301-00-S in Mold & Core Test Handbook, 3rd Edition by American Foundry Society, Des Plaines, Ill., Copyright 2001, which is incorporated by reference herein. Low pressure steam at 3 to 4 psi is then passed through the core mold at approximately 105° C. for about 20 seconds to hydrate the gelatin thereby promoting bonding of the gelatin between adjacent sand particles. The amount of steam required is enough to provide adequate moisture so that the gelatin coating the sand will be hydrated, melt and flow between the sand particles to form connections between the sand particles. Although the amount of steam used is difficult to quantify, the weight of the steam is probably about one to two times the weight of the gelatin used. The temperature of the mold and coated sand should be such that water will condense on the sand to melt the gelatin, which generally means that the temperatures should be less than 100° C.

Finally, hot, dry air is passed through the core mold for approximately 150 seconds to harden the gelatin. The temperature range of the drying air can be quite wide, from approximately ambient temperature to 300° C., with the preferred range being approximately 100 to 150° C. The drying air removes the moisture from the sand in the mold. The heat of the mold and sand will supply enough energy to eventually evaporate the moisture so that the gelatin contains less than about 15% moisture by gelatin weight and is rigid so the sand core will retain its shape after removal from the mold. Using heated air will merely accelerate the drying process and is preferred since it reduces the time it takes to make a core. It is understood that the time for passing steam and dry air through the mold may vary depending upon the dimensions of the mold, how much sand is in the mold, temperature of the mold and drying air, and amount of steam used.

The gelatin coated sand core is then ejected and ready for use. The present invention results in saving energy by eliminating the cooling step and in improving the efficiency of the process by eliminating the conditioning step prior to blowing the sand into the mold. It also eliminates the need for active cooling of the sand molding magazine and blow plate in commercial core blowing equipment. In addition, the present invention eliminates drying and hardening of the gelatin coated sand in the blow tubes caused by tube contact with the heated core box.

As discussed above, the standard method used to make sand cores from gelatin coated sand is to cool the sand to room temperature or below and then add 2 to 3% cold water (based on sand weight assuming 1% gelatin coating) to hydrate the gelatin. This mixture is blown into the heated core mold and after a short dwell time, hot air is blown through the core to dry the gelatin and harden the sand core. It is important to have the hydrated sand temperature below the melting point of the gelatin coating. If the gelatin starts to melt before blowing the core, the sand will become sticky and will not blow uniformly into the mold. This requirement for keeping the hydrated sand cool makes cooling of the sand necessary in actual practice in a foundry where machinery and environmental temperatures can often be over the melting point of the gelatin, which has a melting point of about 25 to 30° C. To avoid the requirement for cooling the hydrated sand in a foundry environment, tests were set up to blow dry, coated sand into the mold, flush steam through the mold, and then dry with hot air.

Figure 3:
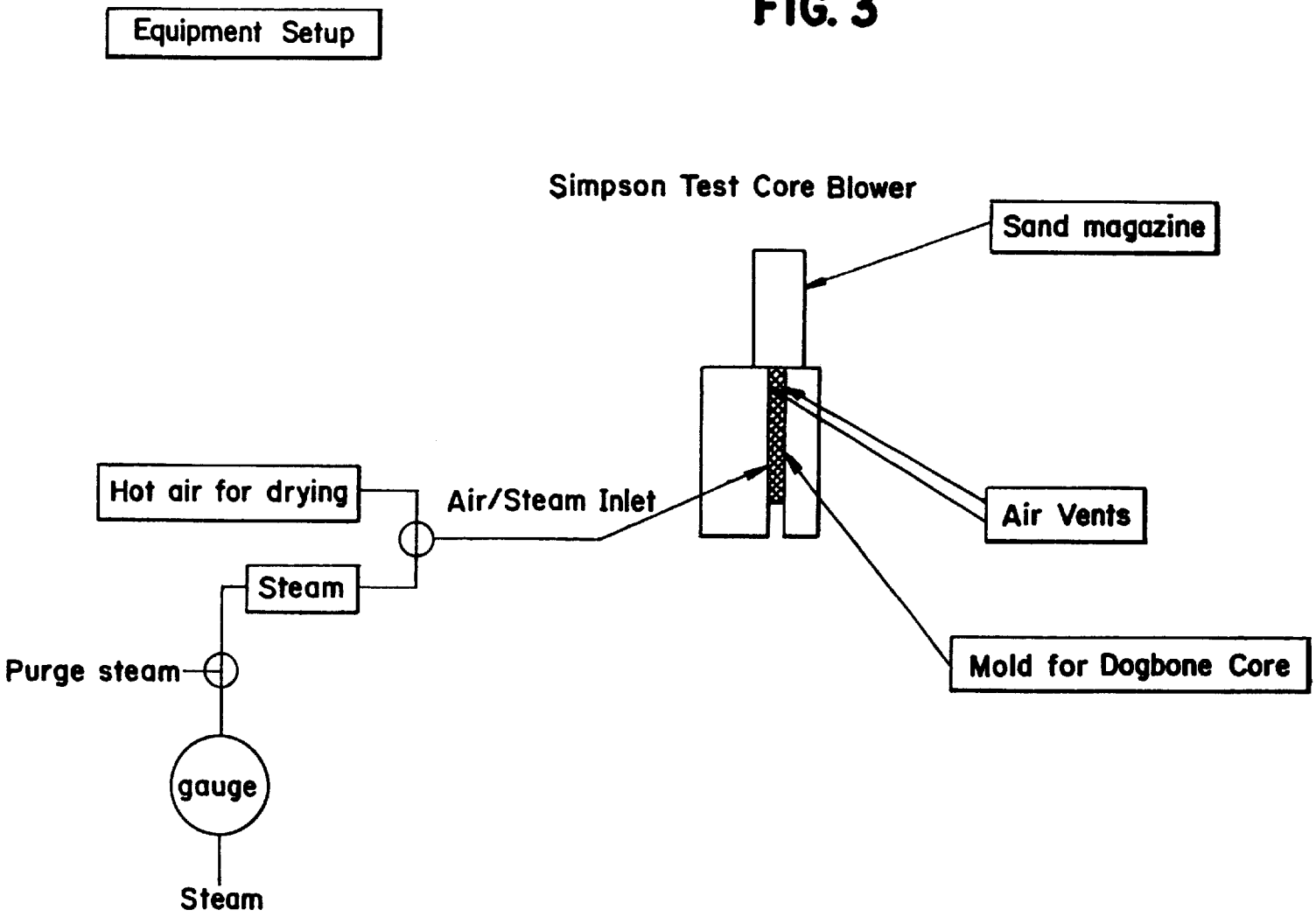
FIG. 3 shows the equipment setup used to evaluate the use of steam to hydrate gelatin coated sand in a core mold.

In the initial testing, 4086 grams of standard 55 gfn (grain fineness number, which measures the average particle size of the sand) lake sand, which is a type of silica sand, was used. Sand coated with 1% GMBOND™ gelatin at Technisand in late February 1999 was used as the room temperature coated sand. To create the heated, coated sand, the sand was heated to approximately 105° C. and was placed in an electrically heated muller with approximately 41 grams of 1% GMBOND™ gelatin. Then 82 grams of water was added to the muller and the sand was mixed until it was dry and free flowing. The dry sand was taken directly out of the muller for making a dog bone core at approximately 55° C. FIG. 3 shows the equipment setup used to evaluate the use of steam to hydrate gelatin coated sand in a core mold rather than hydrating the gelatin coated sand prior to blowing into the core mold.

In the initial tests, "dog bone" cores having the dimensions described above of good strength, greater than 200 psi break force, containing approximately 100 grams of silica sand having a standard shape with a center cross section area of one square inch were made with the following process: First, dry, coated sand either at an ambient temperature or at about 55° C. immediately after coating was blown into the dog bone core mold at approximately 100° C. Steam was flushed through the mold for 20 seconds using the drying air inlets. Using steam at 3 to 4 psi would be approximately 104 to 106° C. Then, hot, dry air at 50 psi and approximately 200° C. was flushed through the mold using the air inlets for 150 seconds, which is the time used in the normal dog bone core procedure, but a shorter time period could be used. Although the break strength was good, the surface finish was not quite as good as the standard dog bone core. This may be due to using the air inlets for the steam and/or having a small amount of condensate in the steam line.

From these tests, the optimum settings were determined. The best core mold temperature is approximately 100° C., and the blowing air is room temperature at 100 psi. The steam is 3 psi and the core box contains a purge to drain open to prevent condensate from accumulating inside the core box. It is important that the steam flow through the core box continuously so that no water accumulates inside the core box. The sand inlet is blocked with a card over the opening and is held down by a pressurized sand magazine while the drying air is flowing through the mold. The best drying air pressure is 50 psi, the temperature is 200° C., the dwell time is 15 seconds, and the drying time is 150 seconds. The results are shown in Table 1 below. These settings are the optimum found for making a dog bone core with good break strength and reasonable surface hardness.

TABLE 1

| | Control Process | 70° C. Sand | 130° C. Sand |
|---|---|---|---|
| Added Moisture | 3% | none | none |
| Steam Pressure Time | none | 3 psi<br>20 seconds | 3 psi<br>20 seconds |

TABLE 1-continued

| | Control Process | 70° C. Sand | 130° C. Sand |
|---|---|---|---|
| Dwell Time | 45 seconds | 15 seconds | 15 seconds |
| Drying Air | | | |
| Temperature | 149° C. | 200° C. | 200° C. |
| Time | 120 seconds | 150 seconds | 150 seconds |
| Press | 100 psi | 50 psi | 50 psi |
| Break Force | 273 psi | 226 psi | 283 psi |
| Scratch Hardness | | | |
| Initial | 89 | 76 | 67 |
| First Turn | 87 | 68 | 57 |
| Second Turn | 82 | 48 | 35 |

Less satisfactory results were obtained in various settings of the tests. If the mold was at the 149° C. used in the standard hydrated sand dog bone core process, the break strength was okay but the surface was very crumbly. This is probably due to the sand being too hot at the surface of the mold to let the steam hydrate the gelatin and bind it. If the mold was at 70° C., it seemed that the break strength was not okay until the dog bone cores were dried in an oven. If the sand inlet was not covered but used in a foil plate that was held down by the pressurized sand magazine, when the drying air was introduced some of the sand would blow out the top before solidification had taken place. With the sand inlet blocked, the air can still escape from the vents on the top corners of the dog bone core mold. Lowering the drying air pressure from 100 to 50 psi helped reduce the tendency to blow the sand out or make holes at the two air inlet ports at the bottom of the dog bone core. At the standard air temperature of 149° C., the dog bone cores did not seem quite dry in 150 seconds, but raising the temperature to 200° C. seemed to get the dog bone core dry. Increasing the steam pressure caused holes to be formed at the air inlet ports. Steam time above 20 seconds just seemed to add excess moisture. Steam was visible coming out of the dog bone core mold vents at about 10 seconds, a 20 second steam purge seemed to give more consistent results than shorter times. Having inlet ports on both sides of the mold could probably improve the surface hardness of the dog bone core using the optimum settings, particularly on the side where the steam drying air inlet ports are located.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of making a molded article for use in a casting process, comprising:

a. mixing sand particles with protein and water to effect a coating of protein on the sand particles;

b. drying the protein coated sand particles;

c. blowing the dry, protein coated sand particles without active cooling into a mold;

d. passing steam through the protein coated sand particles to hydrate and melt the protein, thereby forming protein bonds between contiguous sand particles to form a molded article; and e. passing hot, dry air through the molded article to harden the protein bonds between contiguous sand particles.

2. The method of claim 1, wherein the protein is a type of gelatin.

3. The method of claim 2, wherein gelatin is used at approximately 0.5 to 2.0% of the sand weight.

4. The method of claim 2, wherein a ratio of gelatin to water is approximately 1:1 to 1:5.

5. The method of claim 2, wherein a ratio of gelatin to water is approximately 1:2 to 1:3.

6. The method of claim 1, wherein the drying step is performed using heat.

7. The method of claim 6, wherein the heat is approximately 60 to 120° C.

8. The method of claim 1, wherein the mixing and the drying steps are performed simultaneously.

9. The method of claim 1, wherein the steam is passed through the molded article for approximately 20 seconds at approximately 3 to 4 psi.

10. The method of claim 1, wherein the hot, dry air is passed through the molded article for approximately 150 seconds.

11. The method of claim 10, wherein the hot, dry air is approximately ambient temperature to 300° C.

12. The method of claim 10, wherein the hot, dry air is approximately 100 to 150° C.

13. A method of making a sand core, comprising:

a. mixing sand particles with gelatin and water while supplying heat, wherein the heat melts the gelatin to effect a coating of gelatin on the sand particles and dries the gelatin coated sand particles;

b. blowing the dry, gelatin coated sand particles without active cooling into a mold;

c. passing steam through the gelatin coated sand particles to hydrate and melt the gelatin, thereby forming gelatin bonds between contiguous sand particles to form a molded article; and d. passing hot, dry air through the molded article to harden the gelatin bonds between contiguous sand particles.

14. The method of claim 13, wherein the heat is approximately 60 to 120° C.

15. A method of making a sand core, comprising:

a. mixing sand particles with gelatin and water to create a mixture;

b. supplying heat to the mixture to effect a coating of gelatin on the sand particles and to dry the water thereby drying the mixture;

c. grinding the mixture thereby making the mixture free flowing;

d. blowing the dry, gelatin coated sand particles into a mold;

e. passing steam through the gelatin coated sand particles to hydrate and melt the gelatin, thereby forming bonds between contiguous sand particles to form a molded article; and f. passing hot, dry air through the molded article to harden the gelatin bonds between contiguous sand particles.

16. The method of claim 15, wherein the mixture is heated and dried in an oven.

17. A method of making a sand core, comprising:

a. heating sand particles to above 40° C.;

b. mixing the heated sand particles with gelatin and water, wherein the heated sand particles melt the gelatin thereby coating the sand particles with gelatin;

c. drying the gelatin coated sand particles;

d. blowing the dry, gelatin coated sand particles into a mold;

e. passing steam through the gelatin coated sand particles to hydrate and melt the gelatin, thereby forming gelatin bonds between contiguous sand particles to form a molded article; and f. passing hot, dry air through the molded article to harden the gelatin bonds between contiguous sand particles.

18. The method of claim 17, wherein the mixing and drying steps are performed simultaneously.

19. A method of making a sand core, comprising:

a. mixing sand particles with protein and water to effect a coating of protein on the sand particles;

b. drying the protein coated sand particles;

c. blowing the dry, protein coated sand particles into a mold;

d. rehydrating the protein coating the sand particles within the mold thereby forming protein bonds between contiguous sand particles to form a molded article; and e. passing hot, dry air through the molded article to harden the protein bonds between contiguous sand particles.

20. The method of claim 19, wherein the protein is a type of gelatin.

* * * * *

UNITED STATES PATENT AND TRADEMARK OFFICE

CERTIFICATE OF CORRECTION

PATENT NO. : 6,467,525 B2 
DATED : October 22, 2002
INVENTOR(S) : Richard M. Herreid and Brian J. Srsen It is certified that error appears in the above-identified patent and that said Letters Patent is hereby corrected as shown below:

Title page,
Item [56], References Cited, U.S. PATENT DOCUMENTS, insert the following U.S. patents:

| | | | | |
|---|---|---|---|---|
| -- 2,145,317 | 1/1939 | Salzberg | 106 | 38.4 |
| 4,867,228 | 9/1989 | Novelli et al | 164 | 525 |
| 5,014,763 | 5/1991 | Frank | 164 | 15 |
| 5,262,100 | 11/1993 | Moore et al | 264 | 25 |
| 5,320,157 | 6/1994 | Siak et al | 164 | 12 |
| 5,580,400 | 12/1996 | Takahashi | 148 | 302 |
| 5,749,409 | 5/1998 | Siak et al | 164 | 23 |
| 5,837,373 | 11/1998 | Siak et al | 428 | 404 |
| RE 36,001 | 12/1998 | Siak et al | 164 | 525 -- |

FOREIGN PATENT DOCUMENTS, insert the following:

| | | | | |
|---|---|---|---|---|
| -- EP 0 221 537 | 5/1987 | Europe | C08B | 31/00 -- |

Signed and Sealed this

Eleventh Day of February, 2003

JAMES E. ROGAN
*Director of the United States Patent and Trademark Office*